United States Patent [19]

Holand

[11] 4,312,054

[45] Jan. 19, 1982

[54] ACOUSTIC BEACONS

[75] Inventor: Bård Holand, Trondheim, Norway

[73] Assignee: SINTEF (Selskapet for industriell og teknisk forskning ved NTH), Trondheim, Norway

[21] Appl. No.: 166,554

[22] Filed: Jul. 7, 1980

[51] Int. Cl.[3] ..... H04B 11/00

[52] U.S. Cl. ..... 367/134; 367/137; 367/142; 367/910

[58] Field of Search ..... 367/134, 137, 142, 910; 200/61.04, DIG. 5; 340/850

[56] References Cited

U.S. PATENT DOCUMENTS

| | | | |
|---|---|---|---|
| 3,038,143 | 6/1962 | Dow | 367/134 |
| 3,611,276 | 10/1971 | Massa | 367/134 |
| 3,686,656 | 8/1972 | Richards | 367/142 |
| 3,798,692 | 3/1974 | Madeley | 340/850 X |

*Primary Examiner*—Richard A. Farley

[57] ABSTRACT

Acoustic beacon for use at sea and having a pipe-shaped housing in the one end of which is space for a battery which drives a transmitter disposed coaxially around the housing at the other end where there is arranged a pressure switch covered by a membrane. The transmitter is switched on by the pressure switch when the pressure on the outside of the membrane exceeds a certain limit when the beacon falls in water.

2 Claims, 1 Drawing Figure

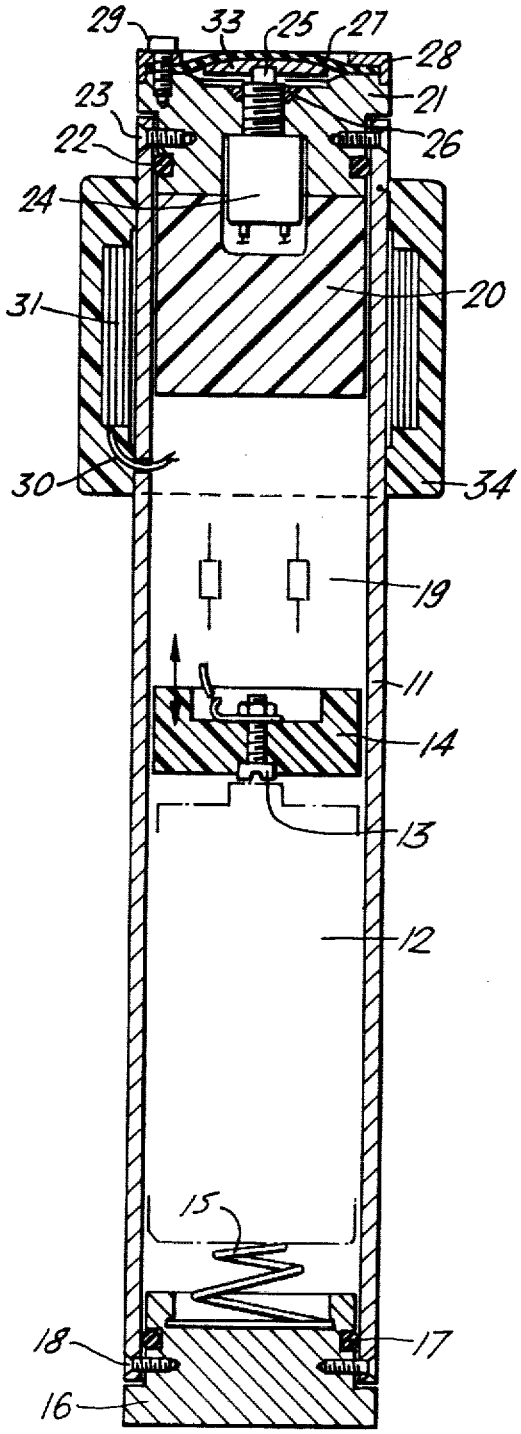
29
33
25
27
28
23
21
22
26
24
20
31
30
34
19
11
14
13
12
15
18
17
16

ACOUSTIC BEACONS

BACKGROUND OF THE INVENTION

1. Field of the Invention

This invention relates to acoustic beacons for objects in oceanic regions and are to be used primarily to indicate the position of boats or other objects present below water, for example, after a wreck.

2. Description of the Prior Art

The locating of wrecks today is a difficult, time-consuming and often expensive task. Often it occurs by chance as a result of fishing operations whereby parts of the wreck are picked up making it possible to determine the position. Active localising of wrecks can be achieved by means of acoustic fish-detection equipment, such as fathometers or sonars, or by way of side-searching sonars. If the position of the object sought after is roughly known, underwater television cameras can also be used.

Hitherto, acoustic beacons or markers have tended to be too expensive and/or too unreliable in operation after an extended period of storage under the demanding conditions prevailing on board ship.

U.S. Pat. No. 3,783,443 (Irick) discloses underwater sound source assemblies which are ejectably mounted on rockets, aircraft, watercraft, precious cargo or any mobile device that may travel over water, to facilitate location and recovery of the device when submerged.

U.S. Pat. No. 3,992,692 (Filer) discloses a self-contained acoustic beacon activated by a sea-water switch for providing an independent method of locating and recovering a floating or submerged recoverable target.

SUMMARY OF THE INVENTION

A main objective of the present invention is, therefore, to create an inexpensive acoustic beacon or marker which, when in a submerged condition, automatically transmits a localising signal capable of being picked up by means of suitable detection equipment. More especially, there is a need for an acoustic beacon or marker with a practical design which permits manufacture at a reasonable cost and storage in a condition of readiness on vessels or objects which are exposed to sinking in water, without the risk of functional breakdown.

According to the present invention an acoustic beacon for objects in oceanic regions comprises a pipe-shaped housing, means for transmitting sound, a battery for driving and a pressure switch for activating said sound-transmitting means, said housing receiving at its one end said battery and at its other end said pressure switch, the latter being adapted to be switched on once the pressure of water surrounding said beacon exceeds a predetermined limit as said beacon falls in said water.

This design provides a simple construction with inexpensive components and, moreover, provides a favorable radiation effect while being easy to make durable against conditions prevailing during storage and use.

BRIEF DESCRIPTION OF THE DRAWING

In order that the invention can be more clearly understood, a preferred embodiment thereof will now be described, by way of example, with reference to the accompanying drawing which is an axial section of an acoustic beacon.

DESCRIPTION OF THE PREFERRED EMBODIMENT

Referring to the drawing, the acoustic beacon has a housing in the form of a pipe 11 made of a corrosion-resistant or surface-treated material. At one end of pipe 11, there is arranged a battery 12 in the form of one or more monocells of conventional design. One terminal of battery 12 forms an abutment against a contact screw 13 which is fixed on a contact piece 14 within the pipe 11. The other terminal forms an abutment against a compression spring 15 which is pressed against the battery 12 in order to hold it fast and provide contact with an end plug 16 which forms a seal against internal walls of pipe 11 by means of gasket 17, the plug being fastened with two locking screws 18 which pass through pipe 11.

Up to the contact piece 14, there are arranged one or more sheets 19 with printed circuits which support electronic parts of the transmitter. This sheet can be designed in a fundamentally known manner and will, therefore, not be described further here. Sheet 19 is supported at the other end by an intermediate piece 20 which is held in place by a second end plug 21. In a manner similar to end plug 16, end plug 21 is made tight against pipe 11 by means of a gasket 22 and is held fast by two locking screws 23.

In addition, there is arranged in end plug 21, for example, by screwing, a pressure switch 24 with an activating means 25 which projects outwardly of the end of the plug, the pressure switch being fastened with locking nuts 26. The activating means 25 is isolated from the surroundings by means of a membrane 27 of appropriate material, for example, rubber, which is held fast on the end plug 21 by means of clamping ring 28 which is fixed with a series of screws 29. In order to reduce the risk of wear on the membrane 27 under the influence of the activating means 25, there is arranged between the membrane and means 25, a pressure plate 33 preferable made of metal or a hard synthetic plastics material.

By means of pressure switch 24, the transmitter on the sheet or sheets 19 is connected, that is to say is supplied with electric current so that there are emitted signal pulses of predetermined form and frequency via an outlet lead 30.

Lead 30 is connected to a transmitter or transducer 31 composed of a ceramic material and having the shape of a pipe which is arranged externally on the pipe-shaped housing 11 at the membrane end. The transducer 31 and the external portion of the lead 30 are molded into an external pipe-shaped block 34 of suitable molding material.

The pressure switch 24 is arranged so that it is activated, that is to say switched on, when the pressure which acts on the membrane 27 exceeds a certain threshold value which corresponds to a specified particular depth.

Such a beacon or marker can first and foremost be used to mark sunken vessels. However, it can also be used for other purposes, for example, for marking fishing operations and the like. A natural application will be in connection with a pressure-registering sensor so that in addition to giving position, the transmitter will also indicate depth. As a result, the possibility is open for fishing boats to utilise the transmitter also to provide information concerning the depth of the fishing operation. This is relevant, for example, in purse seining and trawling.

The beacon or marker of the present invention is extremely quick to operate, the pressure switch starting the transmission instantaneously when the predetermined depth is reached.

The transmitter will thus be an acoustic transmitter. It can, for example, send out pulses having a length of the order of magnitude of 30 ms approximately every 4 seconds. Commercial sonar equipment will then be able to be used for sounding and detection.

I claim:

1. Acoustic beacon suitable for use on a boat and arranged to operate only if the boat is submerged which comprises a pipe-shaped housing spring-loadedly receiving a battery between a first end plug sealingly engaging internal walls of said housing at one end of the latter and contact means, printed circuit means disposed between said contact means and a second end plug sealingly engaging internal walls of said housing at the opposite end of said housing, a pressure switch arranged in and projecting outwardly from said second end plug, a membrane clamped against said second end plug adjacently outward of said pressure switch and allowing the pressure from water surrounding said beacon to be transferred to said pressure switch to switch on the latter once this pressure exceeds a predetermined limit as said beacon falls in said water, means for transmitting sound coaxially supported on the external walls of said housing and towards said opposite end of the latter and electrically connected to said printed circuit means to receive signal pulses therefrom when said printed circuit means is supplied with electric current from said battery with the switching on of said pressure switch.

2. The beacon of claim 1, wherein a pressure plate is mounted between said membrane and said outwardly projecting pressure switch to minimise wear on said membrane.

* * * * *